US009968938B2

(12) United States Patent
Gingras

(10) Patent No.: US 9,968,938 B2
(45) Date of Patent: May 15, 2018

(54) REFINER PLATE WITH GRADUALLY CHANGING GEOMETRY

(71) Applicant: Andritz Inc., Glens Falls, NY (US)

(72) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 33 days.

(21) Appl. No.: 14/019,146

(22) Filed: Sep. 5, 2013

(65) Prior Publication Data

US 2014/0077016 A1 Mar. 20, 2014

Related U.S. Application Data

(60) Provisional application No. 61/701,825, filed on Sep. 17, 2012.

(51) Int. Cl.
*B02C 7/12* (2006.01)
*D21D 1/30* (2006.01)

(52) U.S. Cl.
CPC ..... *B02C 7/12* (2013.01); *D21D 1/306* (2013.01)

(58) Field of Classification Search
CPC ..... B02C 7/12; B02C 18/16; B02C 18/365; B02C 15/003; B02C 18/083; B02C 18/143; B02C 18/146; D21D 1/306; D21D 1/008
USPC ..... 241/261.2, 261.3, 296–298
See application file for complete search history.

(56) References Cited

U.S. PATENT DOCUMENTS 1,662,572 A * 3/1928 Fryer ..... D21D 1/306 241/146
1,715,772 A * 6/1929 Mechlin ..... B02C 7/12 241/298
1,744,226 A * 1/1930 Hussey ..... B02C 7/12 241/251
3,473,745 A * 10/1969 Soars, Jr. ..... B02C 7/12 241/298
4,023,737 A * 5/1977 Leider ..... B02C 7/12 241/261.3
4,676,440 A * 6/1987 Perkola ..... B02C 7/12 241/261.3
4,874,136 A * 10/1989 Webster ..... 241/251
(Continued)

FOREIGN PATENT DOCUMENTS

EP 0363050 11/1990
JP 2005-350848 12/2005
(Continued)

OTHER PUBLICATIONS

First Examination Report issued in the corresponding New Zealand patent application 615392. Sep. 18, 2013.
(Continued)

*Primary Examiner* — James S McClellan
*Assistant Examiner* — Peter Iannuzzi
(74) *Attorney, Agent, or Firm* — Kerri Hochgesang; Robert Joseph Hornung

(57) ABSTRACT

The present disclosure describes a refiner plate segment with one or more continuous, generally spiraling transition zones. A transition zone spans from an area near the inner portion of the plate, near the breaker bar area, and extends toward an area near the periphery of the plate at an angle. A tangent line to the transition zone intersecting a radial line forms this angle. The radial line is formed by a line perpendicular to the outer periphery passing through the center point of the center of plate rotation.

26 Claims, 8 Drawing Sheets

(56) References Cited

U.S. PATENT DOCUMENTS

| | | | | |
|---|---|---|---|---|
| 4,953,796 | A | 9/1990 | Virving | |
| 5,373,995 | A | 12/1994 | Johannson | |
| 5,383,617 | A | 1/1995 | Deuchars | |
| 6,311,907 | B1 * | 11/2001 | Gingras | B02C 7/12 241/261.3 |
| 6,325,308 | B1 * | 12/2001 | Lofgren | B02C 7/12 241/261.3 |
| 6,607,153 | B1 * | 8/2003 | Gingras | B02C 7/12 241/261.2 |
| 7,513,451 | B2 * | 4/2009 | Virving | B02C 7/12 241/298 |
| 9,133,579 | B2 * | 9/2015 | Sjostrom | D21D 1/22 |
| 2002/0070303 | A1 * | 6/2002 | Johansson | B02C 7/12 241/261.3 |
| 2002/0185560 | A1 | 12/2002 | Johansson | |
| 2007/0084952 | A1 * | 4/2007 | Sjostrom | B02C 7/12 241/261.2 |
| 2007/0164143 | A1 * | 7/2007 | Sabourin | B02C 7/12 241/261.2 |
| 2008/0210795 | A1 * | 9/2008 | Antensteiner | D21D 1/306 241/261.3 |
| 2008/0296419 | A1 * | 12/2008 | Gingras | D21D 1/306 241/28 |
| 2009/0001204 | A1 | 1/2009 | Antensteiner | |
| 2009/0302140 | A1 * | 12/2009 | Johansson | B02C 7/12 241/28 |

FOREIGN PATENT DOCUMENTS

| | | | |
|---|---|---|---|
| JP | 2007-113138 | 5/2007 | |
| WO | 2007061599 | 5/2007 | |
| WO | 2009137865 | 11/2009 | |
| WO | 2010097762 | 9/2010 | |
| WO | 2012080931 | 6/2012 | |
| WO | 2012/101330 | 8/2012 | |
| WO | 2012101330 | 8/2012 | |
| WO | WO 2012101330 A1 * | 8/2012 | D21D 1/22 |

OTHER PUBLICATIONS

European Search Report with Written Opinion issued for European Patent Application No. 13184740.2-1710, dated Mar. 18, 2014.

New Zeland IP No. 615392 (Refiner plate with gradually changing geometry), First Examination Report (dated Sep. 2013).

New Zeland IP No. 615392 (Refiner plate with gradually changing geometry), Further Examination Report (dated Nov. 2013)013).

New Zeland IP No. 615392 (Refiner plate with gradually changing geometry), Further Examination Report (dated Jan. 2014).

Japanese Official Action cited in JP Application No. 2013-190013, dated Mar. 14, 2017, three pages.

Translation of Japanese Official Action cited in JP Application No. 2013-190013, four pages.

Chinese Examiner, Notice of fourth office action, dated Feb. 13, 2018, pp. 1-6, Chinese Patent Office, China.

Yukitaka Iwata, Notice of reasons for rejection, dated Feb. 5, 2018, pp. 1-5, Japanese Patent Office, Japan.

* cited by examiner

REFINER PLATE WITH GRADUALLY CHANGING GEOMETRY

RELATED APPLICATION

This invention claims the benefit of U.S. provisional patent application 61/701,825, filed on Sep. 17, 2012, the entirety of which is incorporated herein by reference.

BACKGROUND OF THE INVENTION

1. Technical Field

The present disclosure relates to a rotating refiner plate with a pattern of bars and grooves creating a continuous transition zone spanning from an area near the inner portion of the plate or plate segment (or sector) near the breaker bar zone, to an area near the periphery of the plate or plate segment (or sector).

2. Related Art

Conventional refiner plates generally comprise a substantially annular inner zone characterized by very coarse bars and grooves where feed material is reduced in size and given a radial (from the axis of rotation of the refiner plate toward the periphery) component of movement without substantial refining action. This is called the breaker bar zone. A second, annular outer zone receives the material from the first zone and performs a relatively coarse refining action at its inner portion followed by a higher degree of refining at its outer portion. This outer zone is known as the refining zone.

The refining zones of conventional refiner plates typically have one or more distinct substantially annular refining regions, each having its own bar and grove configuration, with the density of the bar pattern getting higher as one moves from the innermost zone (feeding area) to the outermost zone (exit area). Between each refining region is a transition zone. Transition zones commonly appear to be generally circular or annular or spread over a relatively short distance in an arc relative to the axis of rotation. Transition zones can also incorporate various shapes and configurations, such as the "Z shape" disclosed in U.S. Pat. No. 5,383,617, a "V shape," or "W shape." Even when a transition zone is spread over a certain area, conventional refiner plate designs typically have very separate refining regions with relatively constant bar and groove designs and somewhat restrictive transition zones in between the separate refining regions. Though refiner plates may or may not be segmented, they are usually formed by attaching a plurality of segments or sectors side-by-side (laterally), or in an annular array onto the disc surface, with the zone transitions often being symmetric on either side of a radially extending central axis on each segment or sector.

Refiner plates have been in use for many years to separate wood into individual fibers, as well as to develop these fibers into suitable paper-making or board-making fibers. The process is highly energy-demanding and there have long been attempts at reducing the energy requirement for refining wood into suitable paper-making fiber. Most successful attempts at reducing energy consumption have resulted in an unacceptable drop in the properties and quality of the produced fiber.

Laboratory experiments using a combination of force and temperature sensors have been made with a variety of refiner plate models. It has been found that the most significant detrimental contributor to both energy consumption and fiber quality is a pattern on a refiner plate that leads to a radially uneven fiber pad distribution. This means that the pad of fiber is of uneven thickness on the surface of the refiner plate, especially moving in a radial direction from the inner edge to the outer edge. In other words, undesirable patterns for achieving optimal energy consumption and fiber quality are those which result in a larger accumulation of fiber on a given radial location. Larger radial accumulations are typically associated with points where a bar and groove pattern is changing, typically from a coarser inlet pattern to a finer pattern toward the periphery, or sometimes with a poor radial distribution of dams that restricts flow in the grooves.

To optimize refining performance, full utilization of a plate's refining surface is needed. This requires a gradual reduction in bar and groove widths from the feeding area (usually the inner area) to the exit area. Such a configuration makes the refiner plate better-suited to the combination of the natural feeding behavior of the refiner (more retention in the feeding area) and the gradual reduction in particle size going from wood chips, to fiber bundles, and then to individual fibers.

Typical bar and groove geometries used in refiner plate patterns, namely the transition zones, create areas where feed stock stalls and a large fiber accumulation results. In addition, large fiber accumulation in one area leads to over-refining and unwanted fiber cutting. Areas between the over-refined areas are used with less efficiency, because the low or inadequate amount of fiber accumulation does not facilitate the correct application of energy intensity.

Early attempts to remove fiber buildups caused by the configuration of the transition zones were made by incorporating designs with bars and grooves that converge toward the periphery of the refining zone. These converging bar and groove designs, however, tend to plug easily as feed material is forced in converging channels. These designs also tend to produce patterns with a wider span of pumping and holding bar angles relative to a line extending laterally across a refiner plate segment or sector, producing a less homogeneous fill rate across the refiner plate surface, as well as uneven refining due to some of the material having longer and shorter retention times in the refining zone.

Accordingly, there is a need for an improved refiner plate design with no specific radial transition point between refining zones in order to eliminate radial build-ups of fiber while achieving good operation and producing good and even quality fiber at low energy levels. There is an additional need for an improved refiner plate design with a bar and groove pattern that becomes gradually finer from the axis of rotation to the periphery of the plate to further aid in the elimination of buildups of fiber with minimal negative effects on operation and fiber quality. There is yet another need for restrictions in the refiner plate design, such as with dams, which should be distributed evenly in the radial direction in order to further minimize buildups of fiber without negative effects. It is to these needs and others that the present invention is directed.

BRIEF SUMMARY OF THE INVENTION

Briefly, an embodiment of the present invention comprises a generally spiraling, continuous transition zone, which spans from an area near the inner portion of the plate (feeding area), near the breaker bar area, and extends toward an area near the periphery of the plate (exit area). The outer portion or peripheral edge of the plate segment, being a sector of an entire, assembled circular plate, forms a first arc. The inner portion of the plate segment forms a second arc of a shorter length. The first arc and second arc of the plate segment are parallel arcs. Lines tracing the parallel arcs about an entire assembled plate would form concentric circles. Using this concept, another parallel arc drawn between the first and second arcs of a plate segment (across the plate segment or sector from the left side to the right side) will intersect the continuous transition zone at least once. As used herein, a "parallel arc" means an arc drawn parallel to the first and second arcs formed by the outer and inner edge. Each point of a parallel arc, when drawn along the surface of a plate segment, is equidistant from the center of rotation of the plate. Accordingly, part of the transition zone can be found at any parallel arc drawn intersecting any radial location in the refining area of the refiner plate segment. The refining area comprises the area of the refiner plate segment spanning from an end of the breaker bar section closest the outer periphery to the outer periphery of the refining zone. The effect is to create some bands of relatively short refining regions, which are generally angled relative to the outer periphery of the refiner plate segment or sector. The angle of transition is formed by the intersection of a tangent line to a transition zone and the radial line. The radial line is formed by a line perpendicular to the outer periphery passing through the center point of the plate (center of rotation). The visual bands thus created by the refining regions between the continuous and generally spiraling transition zone can have a constant width or the width can vary from the outermost part of the band (relative to the radial location on the refiner plate) to the innermost part of the band. As used herein, "radial location" means any point along a radial line drawn on a plate segment.

The transition zone in accordance with the present disclosure can be a distinct break from one bar and groove dimension to a different bar and groove dimension, or it can take the form of a dam, with the dam being either at full surface (same level as the top of the bars), or at a level intermediate to the top of the bars and the bottom of the grooves, or it can also be formed by connecting one or more bar ends between the two adjoining zones. Furthermore, the continuous transition zone disclosed herein is generally set at an angle of 20° to 85° (preferably 30° to 80°) drawn between the tangent to the transition zone and the radial line. More precisely, the transition zone is arranged at an angle relative to a radial line passing through the segment of between 30° and 80°. The transition zone can create a visual curved line or straight line, or a combination of curved and straight lines. In accordance with the present invention, the transition area is distributed over the surface of the refining zone of the refiner plate in the general form of a spiral. Ideally, the transition zone location is the same at both edges of a refiner plate segment, so that when a full ring of segments or sectors is created by placing the segments or sectors side-by-side on a refiner disc, the transition zones substantially match up to form a continuous, substantially spiral path from at or near the periphery of the plate toward the axis of rotation. In another embodiment, the transition zone is distributed in a combination of lines forming a substantially spiral shape spanning the refining zone of the refiner plate mounted with refiner plate segments from approximately the outer radius of the refiner plate segment to approximately the inner arc of the refiner plate segment. In other embodiments, the transition zone is distributed in a curve forming a substantially spiral shape spanning at least 50%, or at least 60%, or at least 75% of the surface of the refining zone of the refiner plate. Although this is the preferred embodiment of this disclosure, transition zones that do not align from one segment or sector to the next are within the spirit of the invention so long as the transition zone is substantially evenly distributed radially across each segment.

At any point on the transition zone, the bar and groove dimensions toward the axis of rotation of the refiner plate are coarser or less dense (wider and/or more spaced apart) than the bar and groove dimensions toward the periphery of the refiner plate segment. In other words, the bar and groove configuration is finer (the bar density is greater) moving radially from one refining area band between two transition zones to the next in a direction from the axis of rotation to the periphery of the plate. In addition to the pattern of bars and grooves becoming finer when moving radially across any transition zone band from the axis of rotation to the plate periphery, it is also desirable that such a pattern also becomes finer when moving outward within any band of bars and grooves situated between transition zones. The change in the density of the bars of each transition zone band can become greater in steps, or can change gradually. Such a configuration where bar and groove pattern becomes denser across transition zones as well as within the band of a refining region can be ideal, depending on the relative angle and number of the transition zone bands, because the change from a coarse pattern to a fine pattern becomes even more gradual in the radial direction. The transition zones can be formed from a full surface dam, a subsurface dam connecting the ends of bars from each zone, connected and partially connected bar ends, a distinct break between transition zones, or a combination thereof.

The result of this new geometry is that the bars are no longer continuous, but broken down across every transition area so that the bars do not line up before and after crossing a dam, for example. The new, gradually changing geometry of the refiner plate is applicable to all refiner plates having two or more refining regions and for all known bar and groove shapes, including but not limited to straight bars, curved bars, serrated bars, a logarithmic spiral shape, etc. The plates also can be used in mechanical refiners including, but not limited to, fibrillators, fiberizers, primary refiners, low consistency refiners, medium consistency refiners, high consistency refiners, conical refiners, single disc refiners, double-disc refiners, multiple disc refiners, etc.

In some embodiments, the plate pattern is reversible, and the transition zone may not be continuous from inlet to outlet, but can be mirrored across a centerline in the segment or sector, or can form a double transition zone array, crossing in a "V", a "W", an inverted "V" or "W", or an "X-pattern." These would also be considered to be the same concept as the present invention. These features, and other features and advantages of the present invention will become more apparent to those of ordinary skill in the art when the following detailed description of the preferred embodiments is read in conjunction with the appended figures.

DETAILED DESCRIPTION OF THE PREFERRED EMBODIMENTS

Figure 1:
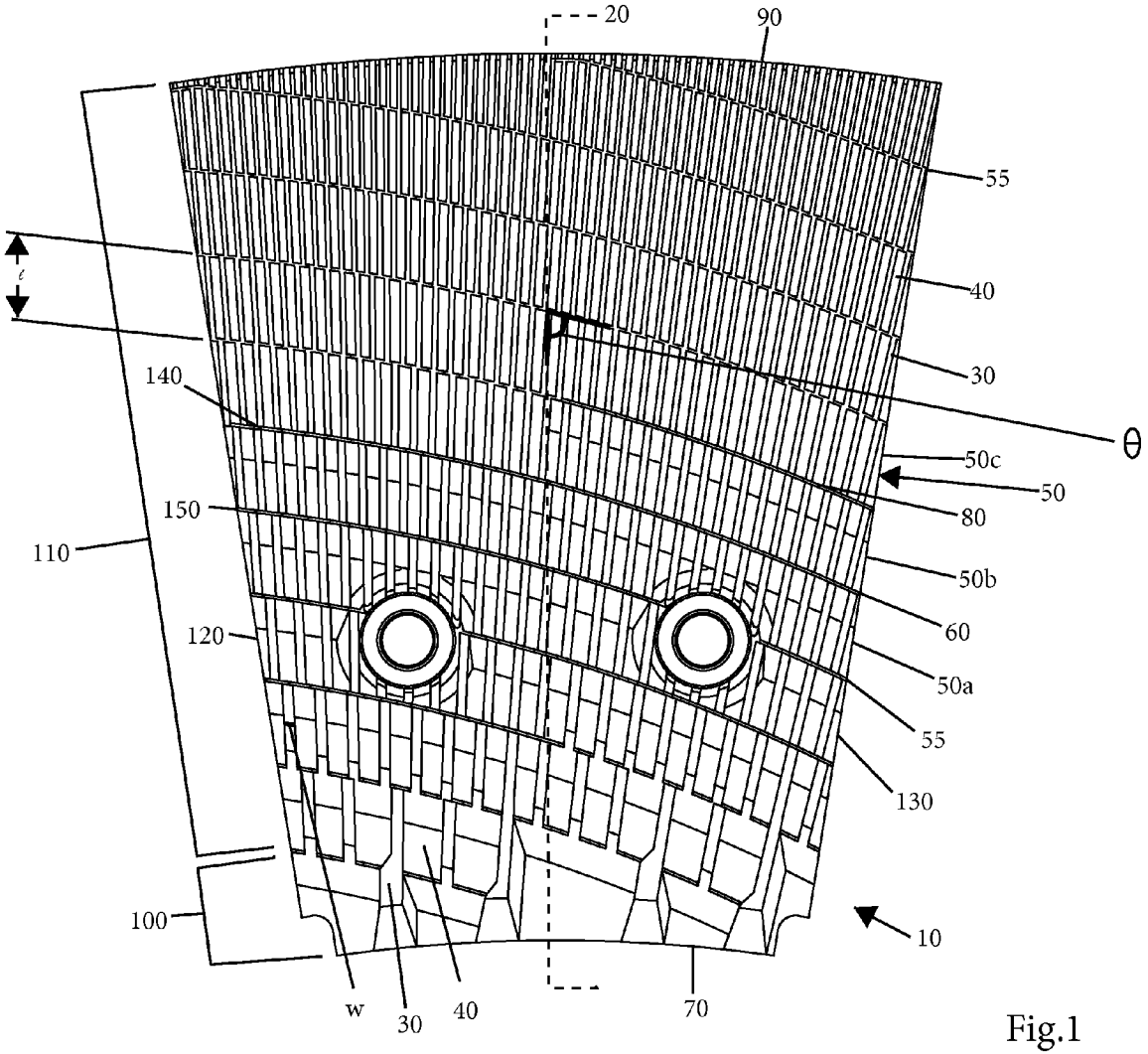
FIG. 1 shows a refiner plate segment having distinct bands of substantially constant width, each featuring substantially parallel bar patterns.

The foregoing detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Illustrative embodiments of a refiner plate design in accordance with multiple embodiments of refiner plate segments or sectors are shown in FIGS. 1-4 and FIGS. 7-8. An embodiment of a refiner plate segment (a sector) comprises a generally spiraling, continuous transition zone, which spans from an area near the exit area of the plate and extends toward a feeding area of the plate. Using this concept, a parallel arc drawn between the first and second arcs of a plate segment will intersect the continuous transition zone at least once such that part of the transition zone can be found at any radial location in the refining area of the refiner plate. Some bands of relatively short refining zones are thus created, which are generally angled relative to the outer periphery of the refiner plate segment. The angle of transition is the angle formed between the radial line and a line tangent to the transition zone, which is an angle of about 20° to 85°. The visual bands thus created by the refining zones between the continuous and generally spiraling transition zone can have a constant width, or the width can vary from the outermost part of the band (relative to the annular location on the refiner plate) to the innermost part of the band. Many variations of this concept can be created, and the following figures are illustrative of the invention.

A pattern for a refiner plate segment or sector for mounting on a refiner disc has been developed. The pattern comprises an outer radius at an outer periphery and an inner radius at an inner arc of the refiner plate segment or sector and a refining zone comprising a pattern of bars and grooves disposed between the outer periphery and inner arc in multiple bands. The patterns of bars in each band have a density, and the density of the bars in each band is greater from the zone nearest the inner arc to the zone nearest the outer periphery. A transition zone is distributed in a line forming a substantially spiral shape spanning the refining zone of the refiner plate mounted with refiner plate segments from approximately the outer periphery to approximately the inner arc of the refining zone, and the transition zone is arranged at an angle relative to a radial line passing through the segment of between 20° and 85°.

In some embodiments of the invention, a refiner plate segment comprises a refining zone having a pattern of bars and grooves and a continuous transition zone in the form of an X. These diamond shapes are created within the refining zone by the X shapes created by the transition zones. Additionally, the density of bars in the pattern of bars and grooves within each diamond shape becomes greater (denser) when moving radially from a diamond shape nearer to an inner arc to a diamond shape further from the inner arc.

Additional embodiments include a refiner plate segment comprising a refining zone having a pattern of bars and grooves and a transition zone within the refining zone. The refining zone contains a transition zone forming spiral bands, and one or more bars span across two or more transition zones. The pattern of bars gets denser when crossing the transition zone in a direction from the inner arc toward the outer periphery. The refiner plate segment may include a first lateral edge and a second lateral edge, where the first lateral edge is closest to the inner arc of the refiner plate segment, and the second lateral edge is closest to the outer arc of the segment, and the pattern of bars gets denser moving in a direction from the first lateral edge to the second edge.

The invention is directed to a refiner plate attached to a substantially circular disc (not shown) for installation in a rotating disc refiner, wherein the plate comprises a plurality of adjacent refiner plate segments 10, each segment 10 having a central axis 20 extending radially and a pattern of alternating raised bars 30 and grooves 40 defined between the bars 30. The bars 30 and grooves 40 extend substantially in parallel such that each bar 30 has a length defined by radially inner and outer ends.

FIG. 1 shows a refiner plate segment 10 having distinct refining zone bands 50 of substantially parallel bars 30, each having a substantially constant length. In this embodiment, the density of bars 30 in a given band, e.g., 50*a*, 50*b*, and 50*c*, becomes greater (the bars 30 are more closely spaced) when moving tangentially and radially along a band, for example, the bars 30 from band 50*a* become more closely spaced when going from the second lateral edge 130 (nearest the inner arc 70 of the segment 10) to the opposite side of the segment 10 at the first lateral edge 120 (nearest the outer periphery 90 of the plate at the exit area). The density of the bars 30 also becomes greater when moving radially toward the outer periphery 90 of the plate segment 10 from one band 50 of bars 30 to the next band 50 of bars 30 (for example, from band 50*a* to 50*b*, and from band 50*b* to 50*c*). This spacing change between the bands 50 of bars 30 in the radial direction results in a continuous, less restricted flow of material over the surface of the refiner plate segment 10, providing a more even distribution of material over the refining zone 110.

The refiner plate segment 10 further comprises a breaker bar zone 100 characterized by very coarse bars 30 and grooves 40 where feed material is reduced in size and given a radial component of movement (from the inner arc 70 of the refiner plate segment 10 toward the outer periphery 90) without substantial refining action. Breaker bar zones 100 are not present in every refiner plate segment and do not affect the scope of this invention. The refining zone 110 receives the material from the breaker bar zone 100 and initially performs a relatively coarse refining action, and as the feed material is moved toward the outer periphery 90 of the plate segment 10 the gradual change to relatively fine, closely spaced bars 30 and grooves 40 provides a gradually higher degree of refining within the refining zone 110.

The embodiment of FIG. 1 shows a refiner plate segment 10 having clear distinct bands 50 of a bar pattern which may be separated by dams 140. The angle of transition is formed by the tangent to the edge of the transition zone 55 and the central axis 20 extending through the center of the plate segment 10 from the inner arc 70 to the outer periphery 90 perpendicular to the outer periphery 90, shown at angle θ.

Along these angled bands 50, the bars 30 are substantially parallel. Each band 50 of the segment 10 starts at a first lateral edge 120 of the segment 10 and runs in a curved or diagonal approximate line toward a second lateral edge 130, either toward (inward) or away from (outward) the inner arc 70. In the exemplary embodiment shown in FIG. 1, starting at the first lateral edge 120 of the segment 10 on the left-hand side, the band 50 moves inward to the second lateral edge 130 on the right-hand side toward the inner arc 70.

The density of the bars 30 gets greater (the bars 30 become more closely spaced) within any given band 50 when moving from a transition zone 55 at the first edge 60 (the edges of band 50*b* are shown here as an example) of the band 50 (nearest the inner arc 70) to a transition zone 55 at the second edge 80 of the band 50 (nearest the outer periphery 90). The spacing of the bars 30 can change gradually at every bar 30, every few bars 30, or even change once, twice or more times across the entire band 50. Additionally, when moving annularly outward (toward the outer periphery 90) from one band 50 to the next band 50 (for example, from band 50*a* to band 50*b*), the bars 30 are more closely spaced in the annularly outward band 50 (in this example, 50*b*).

The effect of this change of bar spacing laterally across the bands 50, (or diagonally) in addition to the annularly (from one band 50 to the next in a direction toward the outer periphery 90, for example, from 50*a* to 50*b* to 50*c*,) in certain embodiments creates a very gradually changing bar spacing moving outward in a radial direction in which the bar pattern gradually gets denser (finer) toward the outer periphery 90 without any large change at any annular location that could cause a peak in flow restriction.

The bands 50 are separated by a continuous surface dam 140 in the outermost transition zones 55 in this case, while a continuous subsurface dam 150 is used to connect the ends of the bars 30 at the innermost transition zones 55. The use of surface and subsurface dams (140, 150) can vary within alternative embodiments, and transition zones 55 featuring no dam are also possible, with the ends of the bars 30 being square, chamfered, connected or separate as required to achieve the right feeding or restrictive effect.

Because the transition zone 55 spans the surface of the refiner plate in a spiral/concentric manner, there is no annularly-concentrated transition area that could cause a peak in flow restriction for the feed material. Additionally, when using a continuous surface dam 140 as a transition zone 55, as shown in FIG. 1 for the outer bands 50 of bars 30, such a surface dam 140 is also radially evenly distributed over the plate and cannot cause any annular concentration of feed material due to many surface dams 140 being found on a similar annular location.

In this first embodiment, the bands 50 of bars 30 are of substantially constant length "l" and thus parallel to one another, and they are continuous, so that when placing two plate segments 10 side-by-side, the bands 50 of bars 30 will form a substantially continuous set of spiral bands 50 connected at the first and second edges 60, 80. While this feature is present in a preferred embodiment, other embodiments comprise bands 50 that do not directly align at the first and second edges 60, 80. These patterns still provide an effectively gradual transition from a coarse pattern of bars 30 and grooves 40 to a relatively finer pattern of bars 30 and grooves 40 from the inner arc 70 to the outer periphery 90, with no clear transition zone 55 that would tend to cause uneven radial accumulation of feed material on the surface of a refiner plate mounted with plate segments 10 as described herein.

Using this concept, a parallel arc drawn across the plate segment 10 at any radial location from the first lateral edge 120 to the second lateral edge 130 will intersect the substantially continuous transition zone 55 at least once. Said another way, part of the transition zone 55 can be found at any radial location in the refining zone 110 of the refiner plate mounted with the refiner plate segments 10 shown herein. The effect is to create some bands 50 of relatively short refining zones 110, which are generally angled relative to the radial line and a tangent to the transition zone 55. The angle of transition θ can be from about 20° to 85°, and preferably from 30° to 80°. The visual bands 50 thus created by the refining zones 110 between the substantially continuous and generally spiraling transition zone 55 can have bars 30 of a constant length "l", or the length "l" can vary. Additionally, the width w of the bars within a visual band 50 can be constant or vary.

Ideally, the gradually changing geometry (pattern) described herein for all embodiments covers at least 50% (or 60% or 75%) of the surface of the refining zone of the plate segment 10 (the refining zone is the area of the plate segment excluding the breaker bar zone 100). There can be some minor discontinuity, such as no more than 10%, in the transition zone 55, while remaining within the scope or spirit of the invention. Specifically, the transition zone may have one or more discontinuities in the pattern of bars and grooves that amount to less than 10% of the surface area of the refining zone. For the purpose of this disclosure, a discontinuity is a pattern substantially, but not completely covering the entire refining zone due to the pattern of bars and grooves falling short of reaching the refiner plate segment edges (the "spiral" is not flush with the edges of the plate, causing the transition zone to stop at a given radius and start again at a slightly different radius.

Figure 2:
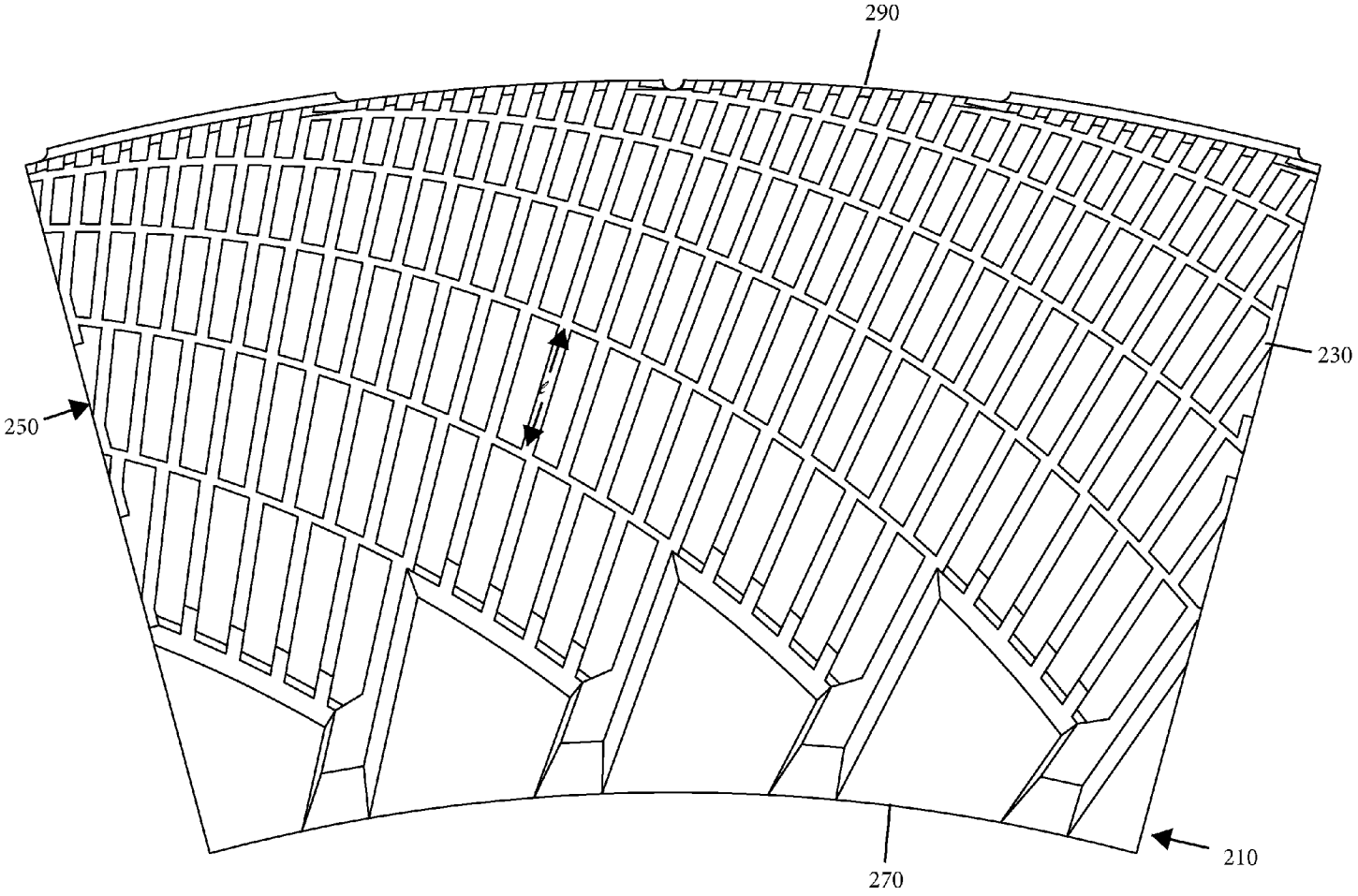
FIG. 2 shows a refiner plate segment having distinct bands of substantially varying width, each featuring substantially parallel bar patterns.

FIG. 2 shows a second embodiment of a refiner plate segment 210 with a gradually changing geometry having distinct bands 250 comprised of a pattern of substantially parallel but varying length "l" bars 230. In this embodiment, the bands 250 of substantially parallel bars 230 are of variable length "l", having a shorter length "l" toward the outer periphery 290 compared to the length "l" of the bars 230 nearest the inner arc 270. The remaining features of the embodiment shown in FIG. 2 are similar to those described in FIG. 1. The density of bars 230 in a given band 250 becomes greater (more closely spaced) when following the band 250 spirally starting at the inner arc 270 and moving along the band 250 toward the outer periphery 290. The density of bars 230 also increases when moving from one band 250 to the next band 250 from the inner arc 270 toward the outer periphery 290. This change in the density of the bars 230 between the bands 250 in these directions results in a continuous, less restricted flow of material over the surface of the refiner plate segment 210.

Figure 3:
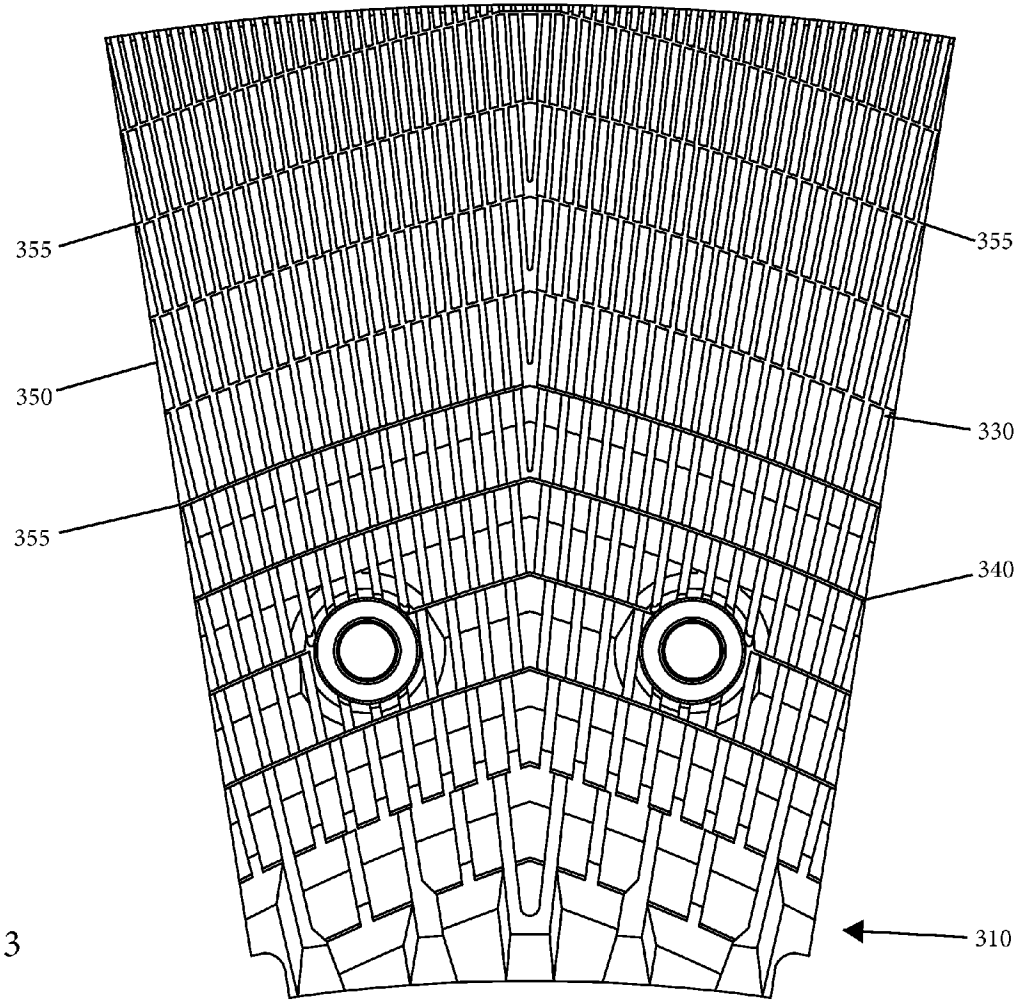
FIG. 3 shows a refiner plate segment for a plate where the direction of rotation of the plate is reversible and the transition zones are making an inverted "V" shape.

FIG. 3 shows an embodiment of a refiner plate segment 310 with a gradually changing geometry that is reversible. In this case, the transition zone 355 forms a "V-shape," or an "inverted V-shape," because the same feeding features are desired in both directions of rotation of a refiner plate mounted with refiner plate segments 310. The bands 350 of substantially parallel bars 330 do not continuously extend in a spiral fashion; they are a mirror of the pattern across the central axis of plate segment 310. This pattern provides the same gradual change of bar density (the spacing of the bars 330) and even distribution of transition zones 355 and dams 340 as FIGS. 1 and 2, but in a reversible version.

Figure 4:
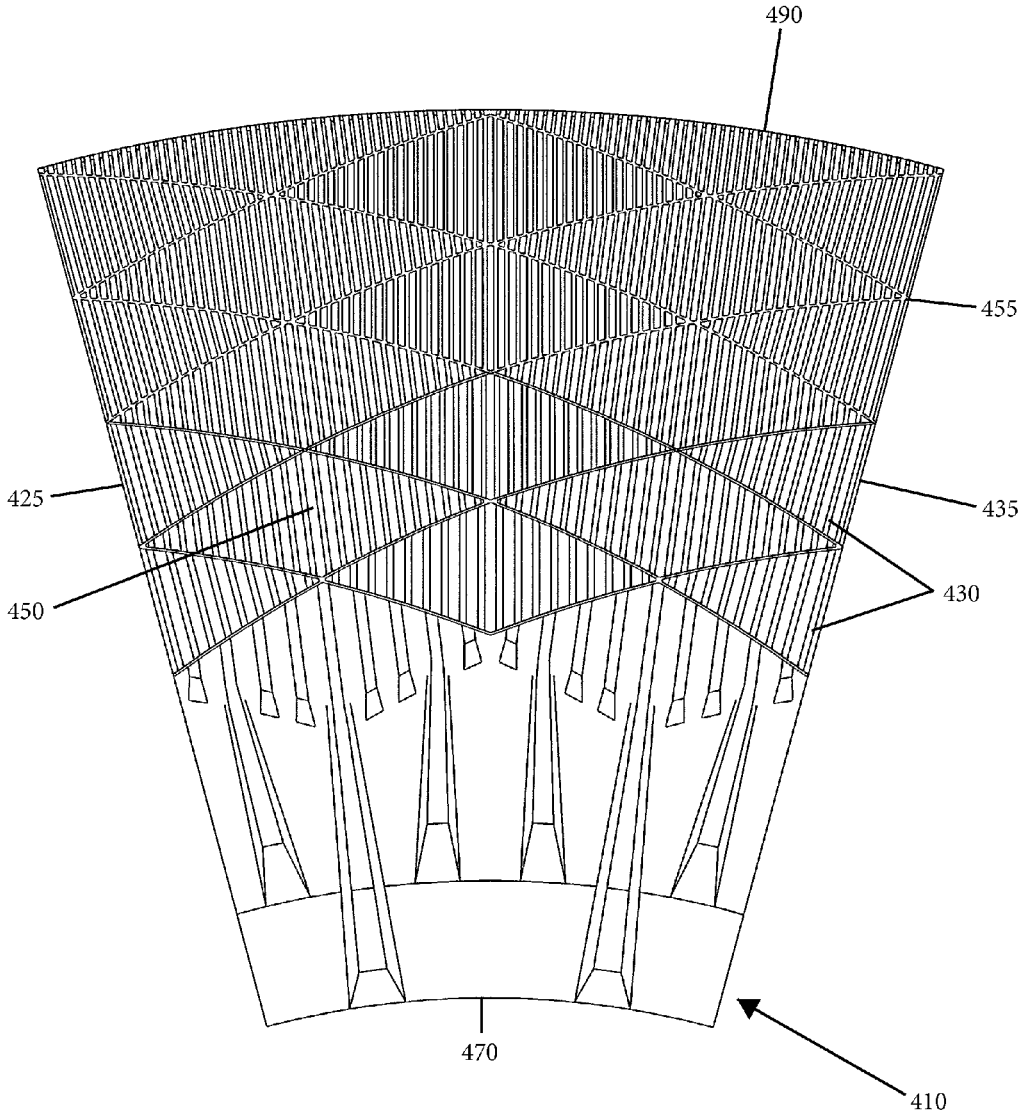
FIG. 4 shows a reversible refiner plate segment where bars are positioned to form an X-shape transition zones.

FIG. 4 shows yet another embodiment of a reversible refiner plate segment 410 with a gradually changing geometry. In this case, instead of using a transition zone 455 that forms a "V-shape," the transition zone 455 of this embodiment forms an "X-shape," and also forms a substantially continuous spiral, crossing itself in both directions (spiraling toward the inner arc 470 from the first lateral edge 425 to the second lateral edge 435, and spiraling toward the inner arc 470 from the second lateral edge 435 to the first lateral edge 425). Again, the density of the bars 430 becomes gradually greater (the spacing becomes narrower) moving from the inner arc 470 toward the outer periphery 490. In this exemplary embodiment, the bars 430 are substantially parallel with substantially equal spacing in each diamond-shaped refining area 450 created by the crossing transition zones 455. The density of the bars 430 increases with each radial step from diamond 450 to diamond 450 from the inner arc 470 toward the outer periphery 490.

Figure 5:
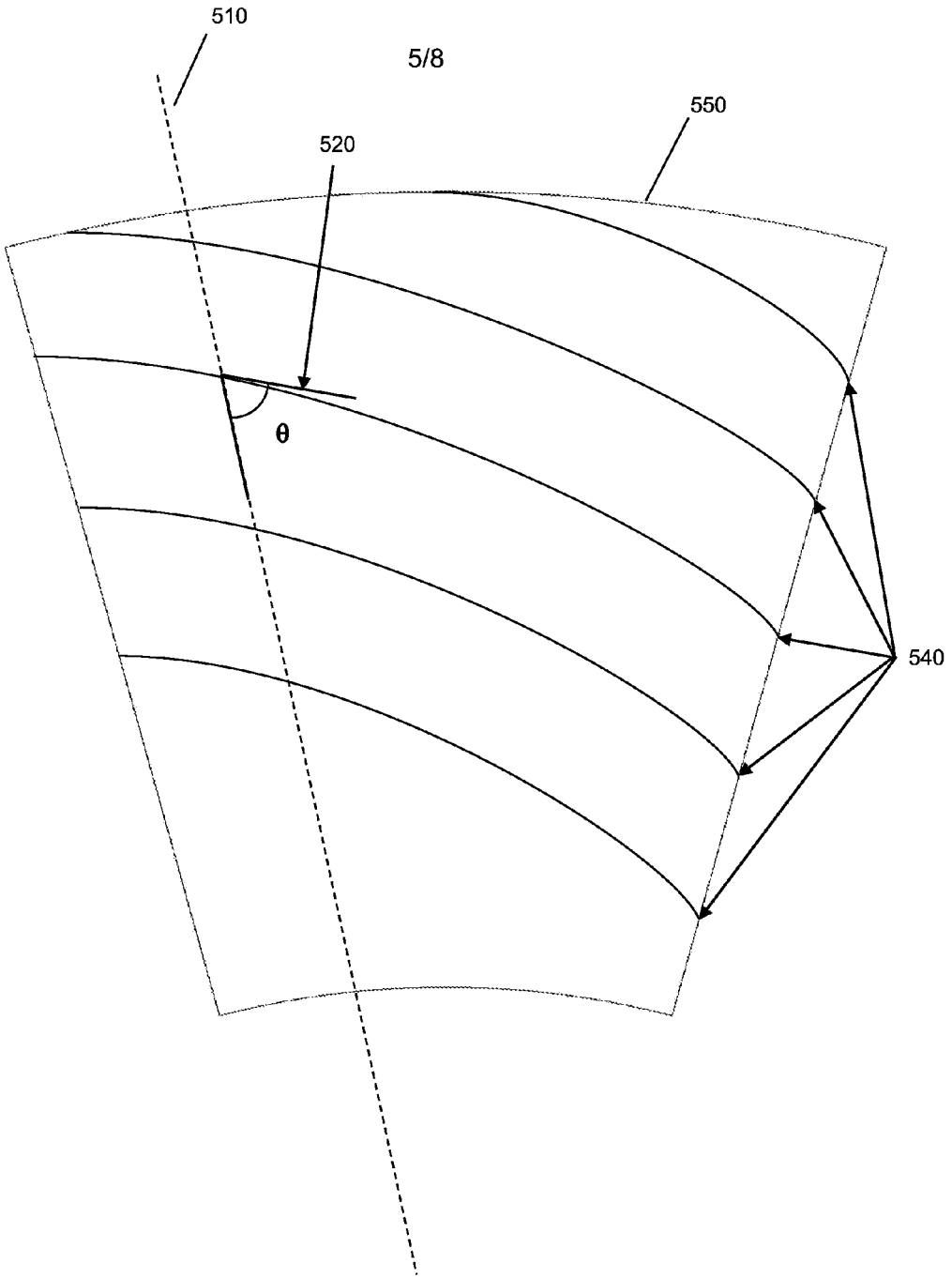
FIG. 5 shows a refiner plate segment transition zones, angle of transition and radial or annular line.

FIG. 5 shows the location of transition zones 540 between bands of bars and grooves in a plate segment such as the one depicted in FIG. 1. A tangent line 520 to a transition zone 540 intersects the radial line 510 to form the angle of transition θ. The radial line 510 is formed by a line perpendicular to the outer periphery 550 passing through the axis of rotation.

Figure 6:
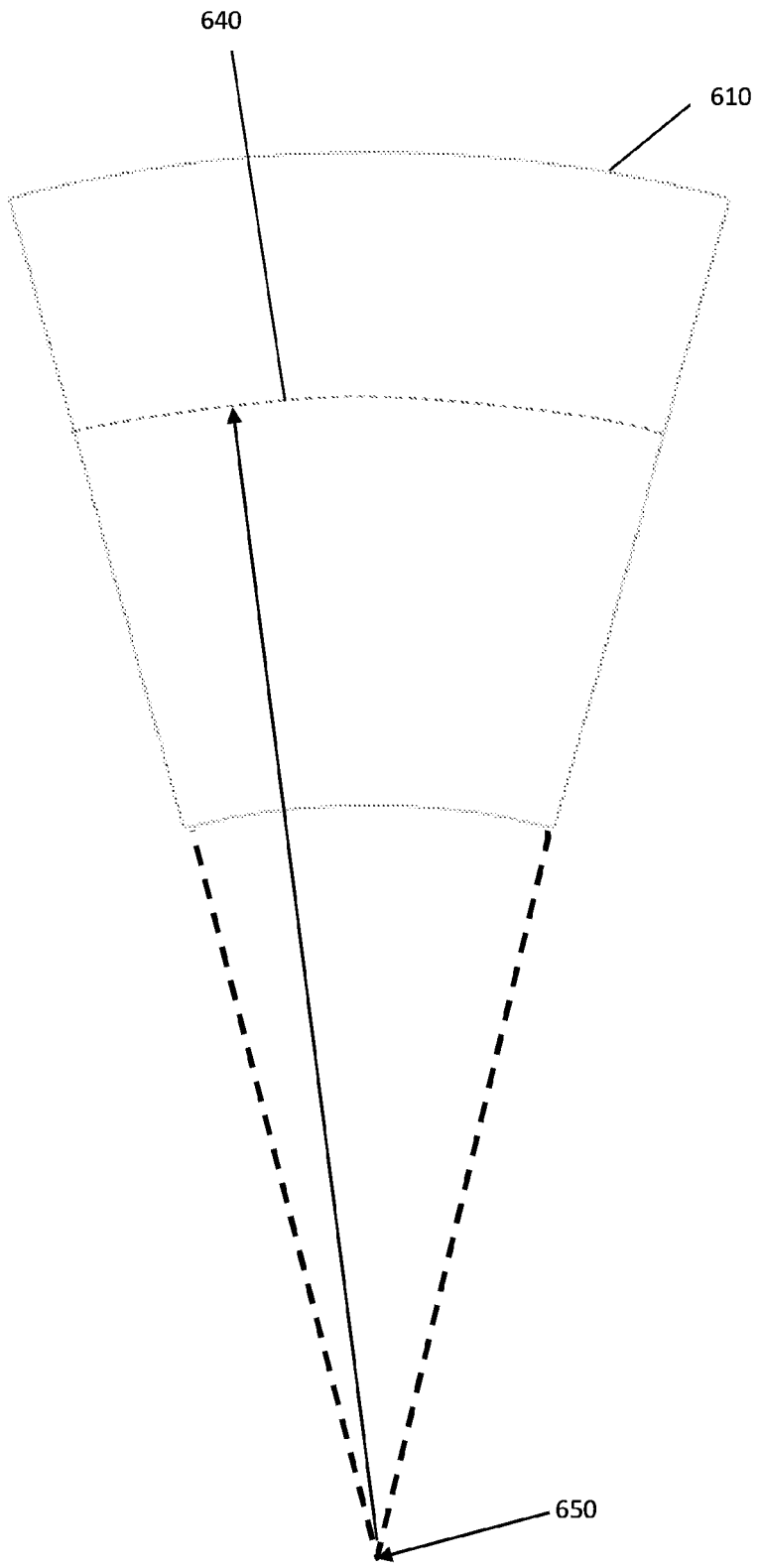
FIG. 6 shows a refiner plate segment defining the radial or annular arc.

FIG. 6 shows a parallel arc 640, wherein all points of the parallel arc 640 are equidistant from the axis of rotation 650 of the refiner plate, and parallel to (or a constant distance from) the periphery 610 of the plate segment. On any parallel arc 640 in the refining zone, one or more spiraling transition zones will be crossing it.

Figure 7:
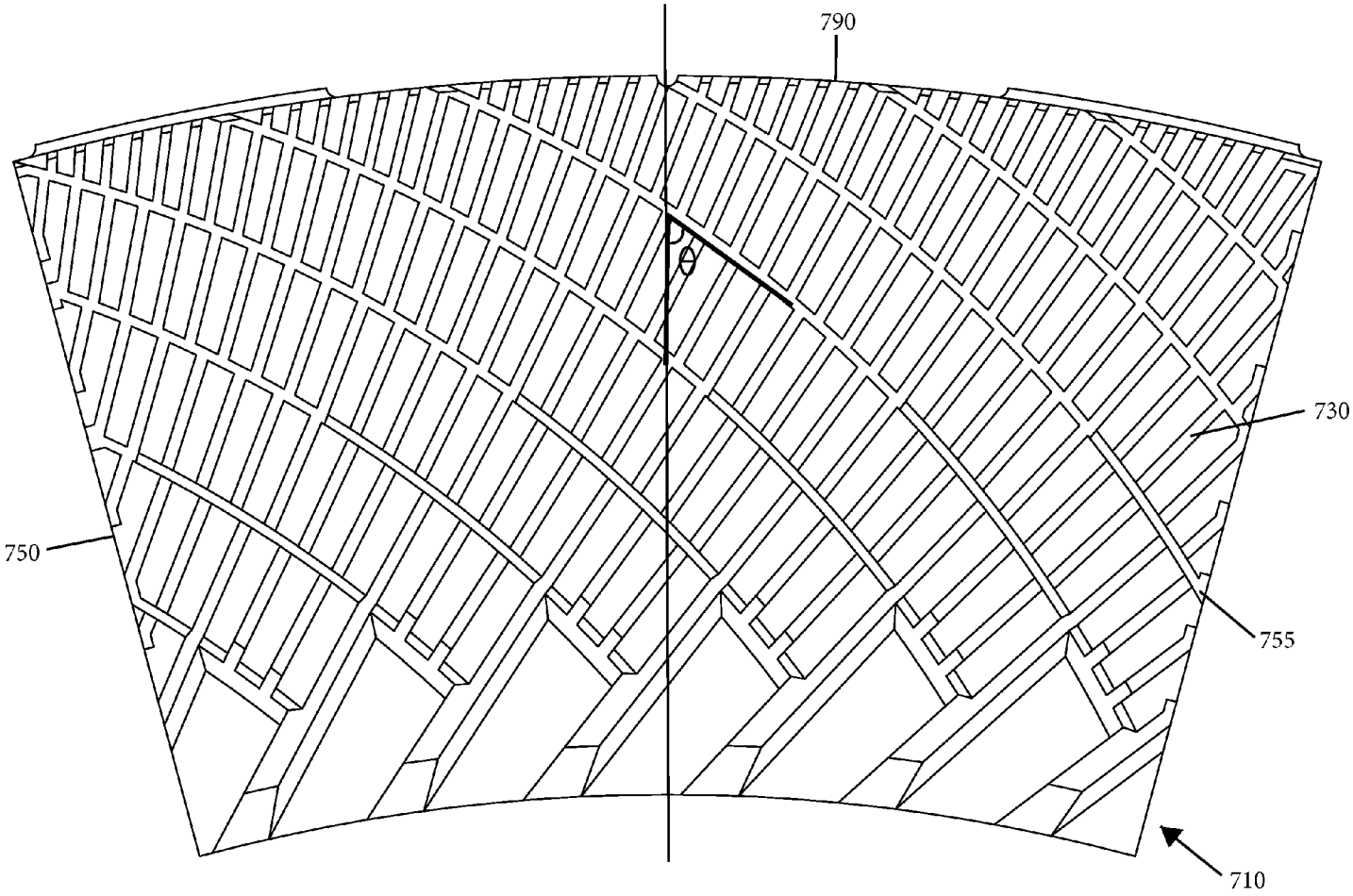
FIG. 7 shows a refiner plate segment having distinct bands, each featuring substantially parallel bar patterns with a steeper angle for the transition zones.

FIG. 7 shows another embodiment of a refiner plate segment 710, similar to FIG. 2, where the transition zones 755 have a steeper angle of transition θ than shown in FIG. 1 or 2. As in FIG. 2, the pattern of bars 730 gets denser when crossing a transition zone 755 toward the periphery 790 of the refiner plate segment 710 or sector. The pattern of bars 730 also gets denser within each band 750 of refining surface, when spiraling outward toward the outer periphery 790. The steeper angle of transition θ may be beneficial in certain applications, as opposed to less angled transition zones such as shown in FIGS. 1 and 2.

Figure 8:
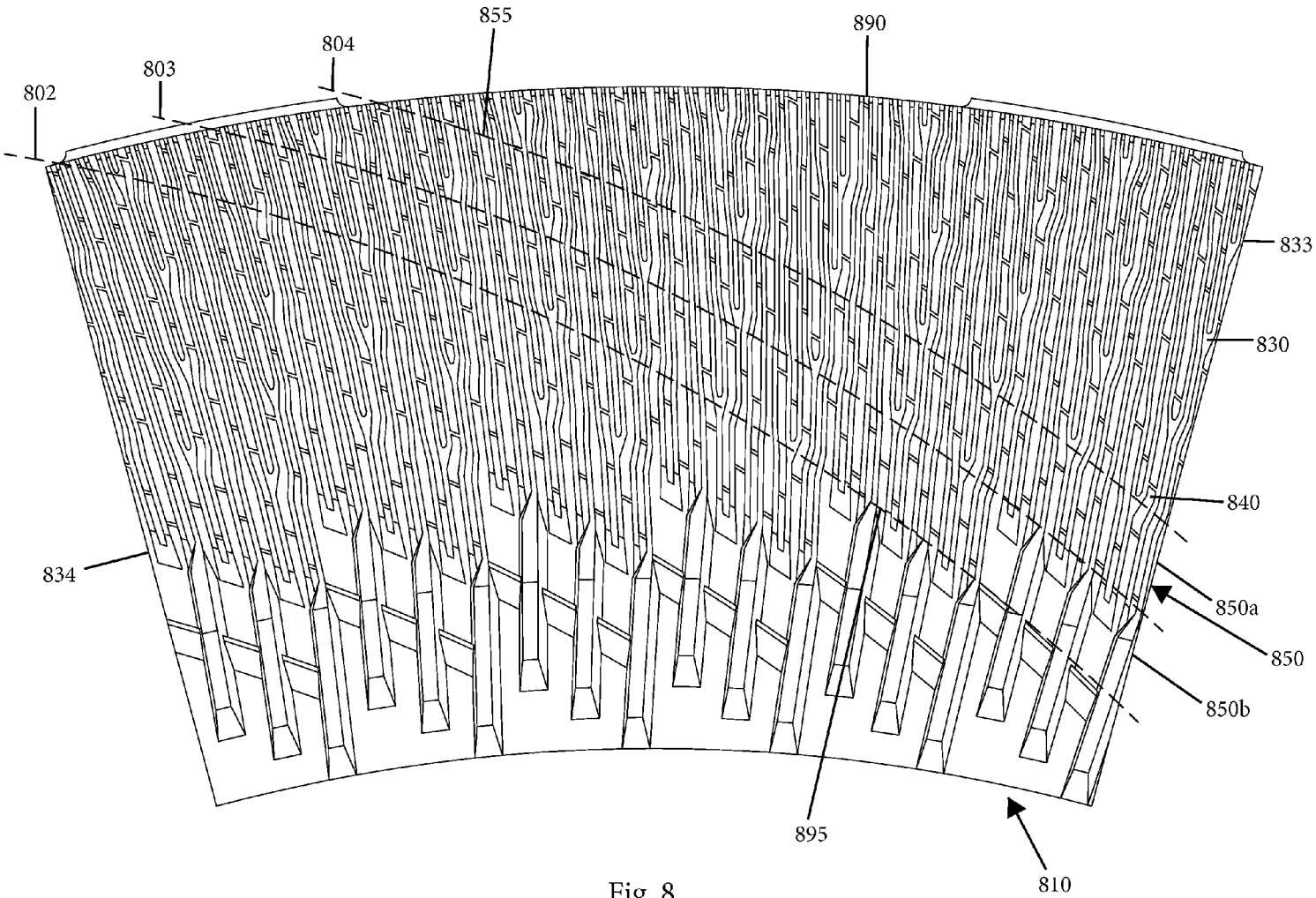
FIG. 8 shows a refiner plate segment having bands, where the ends of bars from adjoining bands are connected.

FIG. 8 shows another embodiment of a refiner plate segment 810 in which the ends of the bars 830 of each spiral band 850 are connected (some bars 830 span across transition zones 855 rather than having a terminus or coinciding with a transition zone 855). The three spiral lines 802, 803, and 804 drawn over the pattern of bars 830 and grooves 840 show where the transition zones 855 are located, e.g., where the pattern of bars 830 gets denser when crossing a transition zone 855 toward the outer periphery 890 of the refiner plate segment 810. The pattern of bars 830 and grooves 840 gradually gets finer (denser) moving from the second lateral edge 833 of the refiner plate segment 810 to the first lateral edge 834 of the refiner plate segment 810 within a band 850, and also going from band to band (for example, from band 850*a* to band 850*b*) when moving radially toward the outer periphery 890 of the plate segment 810. This spacing change between the bands 850 of bars 830 in the radial direction results in a continuous, less restricted flow of material over the surface of the refiner plate segment 810, providing a more even distribution of material over the refining region. In this embodiment, the transition zones 855 between bands 850 are achieved with connections 895 between each of the bands 850. The transition zone 855 of this embodiment can have many different variations, for example, it is possible to connect some of the bars 830 while part of the transition zones 855 contains dams and/or discontinuities.

It is to be understood that the present invention is by no means limited to the particular constructions and method steps herein disclosed or shown in the drawings, but also comprises any modifications or equivalents within the scope of the claims known in the art. It will be appreciated by those skilled in the art that the devices herein disclosed will find utility with respect to multiple refiner plate applications and the like.

What is claimed is:

1. A refiner plate segment comprising:

an outer periphery;

an inner arc distally disposed from the outer periphery;

a first lateral edge;

a second lateral edge distally disposed from the first lateral edge; and a refining surface disposed between the outer periphery and the inner arc comprising:

a pattern of bars and grooves disposed between the outer periphery and the inner arc in multiple bands, wherein the pattern of bars and grooves in each band of the multiple bands has a density, wherein each bar has ends, wherein the pattern of bars and grooves in a first band of the multiple bands disposed closer to the inner arc has a lesser density than a pattern of bars and grooves in an adjacent band of the multiple bands disposed closer to the outer periphery as measured along a radial line configured to extend from a center of rotation of the refiner plate segment when the refiner plate segment is mounted to a mechanical refiner; and a transition zone, wherein the transition zone is arranged at an angle of between 20° and 85° relative to the radial line, wherein the transition zone borders a side of each of the multiple bands, wherein the density of the pattern of bars and grooves increases within each of the multiple bands as measured from a point on each multiple band nearer the inner arc to a point on each multiple band nearer the outer periphery, and wherein the transition zone is distributed in a continuous curved line or a continuous straight line across a structure selected from the group consisting of: a full surface dam, a subsurface dam, dams connecting at least some of the ends of the bars in the first band to at least some of the bars in the adjacent band, and Y-junctions connecting bars between the first band and the adjacent band.

2. The refiner plate segment of claim 1, wherein the transition zone is arranged at an angle of between 30° and 80° relative to the radial line.

3. The refiner plate segment of claim 1, wherein the transition zone is configured to align with a transition zone of an adjacent refiner plate segment to thereby form a spiral shape spanning a refining surface of a refiner plate assembly, wherein the refiner plate assembly comprises two or more refiner plate segments.

4. The refiner plate segment of claim 1, wherein the transition zone is distributed in a curve forming a spiral shape spanning at least 50% of the refining surface.

5. The refiner plate segment of claim 1, wherein the transition zone is distributed in a curve forming a spiral shape spanning at least 60% of the refining surface of a refiner plate.

6. The refiner plate segment of claim 1, wherein the transition zone is distributed in a curve forming a spiral shape spanning at least 75% of the refining surface.

7. The refiner plate segment of claim 3, wherein the transition zone is distributed in a curve forming a spiral shape spanning at least 50% of the refining surface of the refiner plate assembly.

8. The refiner plate segment of claim 3, wherein the transition zone is distributed in a curve forming a spiral shape spanning at least 60% of the refining surface of the refiner plate assembly.

9. The refiner plate segment of claim 3, wherein the transition zone is distributed in a curve forming a spiral shape spanning at least 75% of the refining surface of the refiner plate assembly.

10. The refiner plate of claim 5, wherein the transition zone has one or more discontinuities in the pattern of bars and grooves, the discontinuities amounting to less than 10% of the refining surface.

11. The refiner plate segment of claim 1, wherein the transition zone is radially distributed on at least 50% of the refining surface.

12. The refiner plate segment of claim 1, wherein the refining surface is mirrored along a central axis of the refiner plate segment, wherein the transition zone spans the refining surface, and wherein the transition zone is shaped like a "V," a "W," an inverted "V," or an inverted "W."

13. The refiner plate segment of claim 1, wherein the refining surface is disposed radially outward of a breaker bar section, wherein the breaker bar section is a first refining zone disposed closest to the inner arc of the refiner plate segment.

14. A refiner plate segment comprising:

a refining zone having a pattern of bars and grooves wherein each bar has ends; and transition zones disposed on the refining zone to create X shapes, wherein diamond shapes are created in the refining zone by the X shapes created by the transition zones, and wherein a density of bars in the pattern of bars and grooves within each diamond shape increases radially from a first diamond shape nearer to an inner arc to an adjacent diamond shape further from the inner arc, wherein the transition zone is distributed in a continuous curved line or a continuous straight line across a structure selected from the group consisting of: a full surface dam, a subsurface dam, subsurface dams connecting at least some of the ends of the bars in the first diamond shape to at least some of the bars in the adjacent diamond shape, and Y-junctions connecting bars between the first diamond shape and the adjacent diamond shape.

15. A refiner plate segment comprising:

an outer periphery;

an inner arc disposed across from the outer periphery;

a first lateral edge;

a second lateral edge disposed across from the first lateral edge; and a refining surface having a pattern of bars and grooves, wherein the refining surface is disposed between the inner arc and the outer periphery, the refining surface comprising:

multiple transition zones, wherein the transition zones are parallelly disposed to adjacent transition zones, wherein each transition zone is distributed in a line across a structure selected from the group consisting of: a full surface dam, a subsurface dam, dams connecting at least some of the ends of the bars in the first band to at least some of the bars in the adjacent band, and Y-junctions connecting bars between the first band and the adjacent band, wherein the line spans the refining surface at an angle of between 20° and 85° relative to a radial line passing through the refiner plate segment, wherein the radial line is configured to extend from a center of rotation of the refiner plate segment when the refiner plate segment is mounted to a mechanical refiner, wherein an area between adjacent transition zones forms a spiral band, wherein multiple adjacent transition zones form multiple spiral bands, wherein one or more bars span across two or more transition zones, wherein the pattern of bars has a density, wherein the transition zone is defined by an increase in density between a first spiral band of the multiple spiral bands disposed closer to the inner arc and an adjacent spiral band of the multiple spiral bands disposed further from the inner arc, and wherein the density increases within the multiple spiral bands from a point of each spiral band disposed closer to the first lateral edge to a point of the spiral band disposed closer to the second lateral edge.

16. The refiner plate segment of claim 1, wherein the transition zone is in a form of a V shape or an inverted V shape.

17. The refiner plate segment of claim 15 further comprising a first lateral edge and a second lateral edge, wherein the first lateral corner is defined by a junction of the first lateral edge and the inner arc, and the second lateral corner is defined by a junction of the second lateral edge and the outer periphery, and wherein the density of the pattern of bars increases from the first lateral edge to the second lateral edge.

18. The refiner plate segment of claim 1, wherein the multiple bands are distributed on 100% of the refining surface.

19. A refiner plate segment comprising:

an outer periphery;

an inner arc distally disposed from the outer periphery;

a first lateral edge;

a second lateral edge disposed across from the first lateral edge; and a refining surface having a first transition zone, a second transition zone, and a third transition zone, wherein each of the first transition zone, the second transition zone, and the third transition zone is distributed in a line across a structure on the refining surface selected from the group consisting of: a full surface dam, a subsurface dam, dams connecting at least some of the ends of the bars in the first band to at least some of the bars in the adjacent band, and Y-junctions connecting bars between the first band and the adjacent band, wherein the first transition zone and the second transition zone are disposed between the outer periphery and the inner arc, wherein the second transition zone is parallel to the first transition zone and wherein the second transition zone is disposed radially outward from the first transition zone, wherein the first transition zone and second transition zone are arranged at an angle relative to a radial line extending from the inner arc to the outer periphery, wherein the radial line is configured to extend from a center of rotation of the refiner plate segment when the refiner plate segment is mounted to a mechanical refiner, and wherein an area between the first transition zone and a second transition zone defines a first band having a pattern of bars and grooves, wherein the bars have ends wherein the third transition zone is disposed between the outer periphery and the inner arc, wherein the third transition zone is parallel to the first transition zone and wherein the third transition zone is disposed radially outward from the second transition zone, wherein an area between the second transition zone and the third transition zone defines a second band having a pattern of bars and grooves, wherein the bars have ends, wherein the pattern of bars and grooves in the first band and the second band have a density, wherein the density of the pattern of bars and grooves in the second band is denser than the pattern of bars and grooves in the first band as measured along the radial line, wherein the first transition zone, the second transition zone, and the third transition zone are defined by an increase in density between the first band and the second band, wherein the density of the pattern of bars and grooves in the first band increases from an inner end of the first band to an outer end of the first band, the outer end of the first band being distally disposed from the inner end of the first band, and wherein the density of the pattern of bars and grooves in the second band increases from an inner end of the second band to an outer end of the second band, the outer end of the second band being distally disposed from the inner end of the second band.

20. The refiner plate segment of claim 19, wherein the inner end of the first band is disposed at the first lateral edge of the refiner plate segment and the outer end of the first band is disposed at the second lateral edge of the refiner plate segment.

21. The refiner plate segment of claim 19, wherein one or more bars in a pattern of bars and grooves crosses over two or more transition zones.

22. A refiner plate segment comprising:

an outer periphery;

an inner arc distally disposed from the outer periphery;

a first lateral edge;

a second lateral edge disposed across from the first lateral edge; and a refining surface comprising:

a pattern of bars and grooves disposed between the outer periphery and the inner arc in multiple bands, wherein the pattern of bars and grooves in each band of the multiple bands has a density, wherein the density of the pattern of bars and grooves in a first band of the multiple bands disposed closer to the inner arc has a lesser density than the density of the pattern of bars and grooves in an adjacent band of the multiple bands disposed closer to the outer periphery;

a transition zone, wherein the transition zone is defined by an increase in density between the first band disposed closer to the inner arc and an adjacent band disposed further from the inner arc as measured along a radial line extending from the inner arc to the outer periphery, wherein the radial line is configured to extend from a center of rotation of the refiner plate segment when the refiner plate segment is mounted to a mechanical refiner wherein the transition zone is arranged at an angle of between 20° and 85° relative to the radial line, wherein the transition zone borders a side of at least one of the multiple bands, wherein each transition zone is distributed in a line across a structure selected from the group consisting of: a full surface dam, a subsurface dam, dams connecting at least some of the ends of the bars in the first band to at least some of the bars in the adjacent band, and Y-junctions connecting bars between the first band and the adjacent band, and wherein the pattern of bars and grooves becomes denser within at least one of the multiple bands as measured from the first lateral edge to a point of the refining surface nearest the outer periphery.

23. The refiner plate segment of claim 1, wherein the transition zone is configured to align with a transition zone of a right adjacent refiner plate segment and a left adjacent refiner plate segment to thereby form a spiral shape spanning a refining surface of a refiner plate assembly comprising three or more refiner plate segments, wherein the spiral shape of the refiner plate assembly extends from a radially outer perimeter to a radially inner perimeter of the refining surface.

24. The refiner plate segment of claim 1, wherein the refining surface is disposed on at least 30% of an area between the inner arc and the outer periphery.

25. The refiner plate segment of claim 1, wherein at least two bands of the multiple bands extend to the second lateral edge of the refiner plate segment, wherein a first band of the at least two bands is configured to align with a first adjacent band on an adjacent refiner plate segment, wherein a second band of the at least two bands is configured to align with a second adjacent band on the adjacent refiner plate segment, and wherein each of the first adjacent band and the second adjacent band extend to a first lateral edge of the adjacent refiner plate segment.

26. The refiner plate segment of claim 25, wherein the first adjacent band and the second adjacent band asymptotically approach a tangent line at the outer periphery of the adjacent refiner plate segment.

* * * * *